US009758978B2

(12) United States Patent
Shlomi-Shlomi et al.

(10) Patent No.: US 9,758,978 B2
(45) Date of Patent: Sep. 12, 2017

(54) CLEANING BRUSH FOR A POOL CLEANING APPARATUS

(71) Applicant: MAYTRONICS LTD., Kibutz Yizrael (IL)

(72) Inventors: Idan Shlomi-Shlomi, Mitzpe Aviv (IL); Igor Grubman, Haifa (IL)

(73) Assignee: MAYTRONICS LTD., Kibbuts Yizrael (IL)

( * ) Notice: Subject to any disclaimer, the term of this patent is extended or adjusted under 35 U.S.C. 154(b) by 579 days.

(21) Appl. No.: 14/230,032

(22) Filed: Mar. 31, 2014

(65) Prior Publication Data

US 2014/0366297 A1 Dec. 18, 2014

(30) Foreign Application Priority Data

Jun. 16, 2013 (IL) ..... 226976

(51) Int. Cl.
*E04H 4/16* (2006.01)

(52) U.S. Cl.
CPC ..... *E04H 4/16* (2013.01); *E04H 4/1654* (2013.01)

(58) Field of Classification Search
CPC ..... E04H 4/16; E04H 4/1654
See application file for complete search history.

(56) References Cited

U.S. PATENT DOCUMENTS 1,815,084 A * 7/1931 White ..... A47L 9/0477 15/179
1,888,339 A * 11/1932 White ..... A47L 9/0455 15/376
1,894,361 A * 1/1933 Shank ..... A47L 9/0477 15/141.2
2,334,714 A * 11/1943 Knight ..... C14B 1/44 15/40
3,139,641 A * 7/1964 Grogan ..... A46B 13/005 15/179
4,209,873 A * 7/1980 Schaefer ..... A47L 5/30 15/182
5,337,434 A 8/1994 Erlich
6,003,186 A † 12/1999 Larson
D682,497 S * 5/2013 Wargo ..... D15/138

FOREIGN PATENT DOCUMENTS

DE 102004042786 A1 3/2006
EP 1978184 A2 10/2008
WO WO 2012/023676 2/2012

* cited by examiner
† cited by third party

*Primary Examiner* — Randall Chin
(74) *Attorney, Agent, or Firm* — Reches Patents

(57) ABSTRACT

An cleaning brush for a pool cleaning apparatus, the cleaning brush that includes: a central portion that has a longitudinal axis; a right handed fin that surrounds a first section of the central portion; a left handed fin that surrounds a second section of the central portion; first protuberances that are oriented in relation to the right handed fin; and second protuberances that are oriented in relation to the left handed fin.

13 Claims, 14 Drawing Sheets

100

100

200

CLEANING BRUSH FOR A POOL CLEANING APPARATUS

RELATED APPLICATIONS

This application claims the priority of Israeli patent application serial number 226976 filing date Jun. 16, 2013 which is incorporated herein by reference.

BACKGROUND

There is a continuous need for improving the scrubbing and cleaning abilities of cleaning apparatuses in general, such as indoor floor cleaners and submersible pool cleaning apparatuses specifically, such as pool cleaning robots. Besides vacuuming and filtering incoming pumped water, the performance of the brushing, scrubbing and/or algae trimming functions and their qualities are paramount. The cleaning and pool cleaning industry are using a variety of different types of brushes for a variety of tasks. In addition to scrubbing floor surfaces and/or pool walls and sweeping the accumulated dirt, other prominent function of the brushes is to direct said brushed and swiped dirt towards a suction inlet of a pool cleaning apparatus for vacuuming said dirty water into the pool cleaner filtering system. These brushes rely mainly on the vacuum and suction power of the pool cleaner apparatus to be able to capture the dirt into the suction inlet. With this purpose in mind, at the present moment, most brushes designs can achieve only partial dirt diversions effectiveness.

There is a growing need to provide more effective cleaning brushes for pool cleaning apparatuses.

SUMMARY

According to an embodiment of the invention a cleaning brush may be provided which trims algae and converges the loose dirt efficiently towards the suction inlet.

According to an embodiment of the invention there is provided cleaning brush for a pool cleaning apparatus, the cleaning brush may include a central portion that has a longitudinal axis; a right handed fin that surrounds a first section of the central portion; a left handed fin that surrounds a second section of the central portion; first protuberances that are oriented in relation to the right handed fin; and second protuberances that are oriented in relation to the left handed fin.

The first and second sections may be of equal length.

The first and second protuberances may be substantially parallel to the longitudinal axis.

The right handed fin and the left handed fins may be mutually symmetrical about an imaginary axis that virtually separates the first and second sections.

The cleaning brush may include an adaptor for detachably connecting the cleaning brush to the pool cleaning apparatus; and at least one opening that facilitates a detachment of the cleaning brush from the pool cleaning apparatus by manipulation of the adaptor.

The adaptor may include a snap action lock that is accessible through the at least one opening.

The left handed fins, the right handed fins, and the first and second protuberances may be over molded the central portion.

Each one of the right handed fin and the left handed fin may define a helical path.

The cleaning brush may include multiple right handed fins and multiple left handed fins. The multiple right handed fins can be spaced apart from each other. The multiple left handed fins can be spaced apart from each other.

According to an embodiment of the invention there may be provided a cleaning brush for a pool cleaning apparatus, the cleaning brush may include: a central portion that has a longitudinal axis; first fins that have a positive slope in relation to the longitudinal axis and surround a first section of the central portion; second fins that have a negative slope in relation to the longitudinal axis and surround a second section of the central portion; first protuberances that are oriented in relation to the first fins; and second protuberances that are oriented in relation to the second fins.

Each one of the first and second groups of fins may include multiple ring shaped fins that are spaced apart from each other.

The first and second sections may be equal each other or may differ by size, and/or shape.

An absolute value of the positive slope may substantially equal an absolute value of the negative slope.

The first and second protuberances may be substantially parallel to the longitudinal axis.

The first and second protuberances may be not parallel to each other.

The cleaning brush may include an adaptor for detachably connecting the cleaning brush to the pool cleaning apparatus; and at least one opening that facilitates a detachment of the cleaning brush from the pool cleaning apparatus by manipulation of the adaptor.

The adaptor may include a snap action lock that is accessible through the at least one opening.

The left handed fins, the right handed fins, and the first and second protuberances may be over molded the central portion.

According to an embodiment of the invention there may be provided a pool cleaning apparatus, that may include (a) a first cleaning brush that may include: a first central portion that has a first longitudinal axis; a first right handed fin that surrounds a first section of the first central portion; and a first left handed fin that surrounds a second section of the first central portion; (b) a second cleaning brush that may include: a second central portion that has a second longitudinal axis; a second right handed fin that surrounds a first section of the second central portion; and a second left handed fin that surrounds a second section of the second central portion; and (c) a movement module that is arranged to rotate the first and second cleaning brush about their longitudinal axes.

The first cleaning brush may include: first protuberances that are oriented in relation to the first right handed fin; and second protuberances that are oriented in relation to the first left handed fin.

The second cleaning brush may include third protuberances that are oriented in relation to the second right handed fin; and fourth protuberances that are oriented in relation to the second left handed fin.

The first and second protuberances may be substantially parallel to the longitudinal axis.

The first and second sections may be of equal length.

The first right handed fin and the first left handed fins may be mutually symmetrical about an imaginary axis that virtually separates the first and second portions of the first central portion.

Each of the first and second cleaning brushes may include an interface for detachably connecting the cleaning brush to the pool cleaning robot; and at least one opening that facilitates a detachment of the cleaning brush from the pool cleaning apparatus by manipulation of the interface.

The first and second cleaning brushes may be substantially parallel to each other.

The movement module may be arranged to rotate the first and second cleaning brushes at a same rotational direction about their longitudinal axes.

The movement module may be arranged to rotate the first and second cleaning brushes at the same rotational direction about their longitudinal axes thereby causing a front cleaning brush out of the first and second cleaning brushes to direct debris towards a fluid inlet of the pool cleaning apparatus and to causing a rear cleaning brush out of the first and second cleaning brushes to direct debris away from a center of the pool cleaning robot.

The pool cleaning apparatus may include at least one intermediate cleaning brush positioned between the first and second cleaning brushes and rotating at different speed than each of said brushes.

According to an embodiment of the invention there may be provided a pool cleaning apparatus that may include a first cleaning over molded+snap locked brush that may include: (i) a first central portion that has a first longitudinal axis; first fins that have a first positive slope in relation to the first longitudinal axis and surround a first section of the first central portion and second fins that have a first negative slope in relation to the first longitudinal axis and surround a second section of the first central portion; (ii) a second cleaning brush that may include: a second central portion that has a second longitudinal axis; third fins that have a second positive slope in relation to the second longitudinal axis and surround a first section of the second central portion; and fourth fins that have a second negative slope in relation to the second longitudinal axis and surround a second section of the second central portion; and (iii) a movement module that may be arranged to rotate the first and second cleaning brush about their longitudinal axes.

The first fins may include multiple ring shaped fins that are spaced apart from each other.

The third fins may include multiple ring shaped fins that are spaced apart from each other.

The first and second sections of each one of the first and second central portions may equal each other.

The absolute value of the first positive slope may substantially equal an absolute value of the first negative slope.

The absolute value of the second positive slope may substantially equal an absolute value of the second negative slope.

The absolute value of the first positive slope may substantially differ from an absolute value of the first negative slope.

The first cleaning brush further may include first protuberances that are oriented in relation to the first fins; and second protuberances that are oriented in relation to the second fins.

The second cleaning brush further may include third protuberances that are oriented in relation to the third fins; and fourth protuberances that are oriented in relation to the fourth fins.

The first and second protuberances may be substantially parallel to the longitudinal axis.

The first and second protuberances may not be parallel to each other.

The first and second protuberances may be arranged in rows.

The first and second protuberances may be arranged in a staggered manner.

Each one of the first and second cleaning brushes may include an internal brush adaptor interface for detachably connecting the cleaning brush to the pool cleaning robot; and at least one opening that facilitates a detachment of the cleaning brush from the pool cleaning apparatus by manipulation of the interface.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

Figure 1:
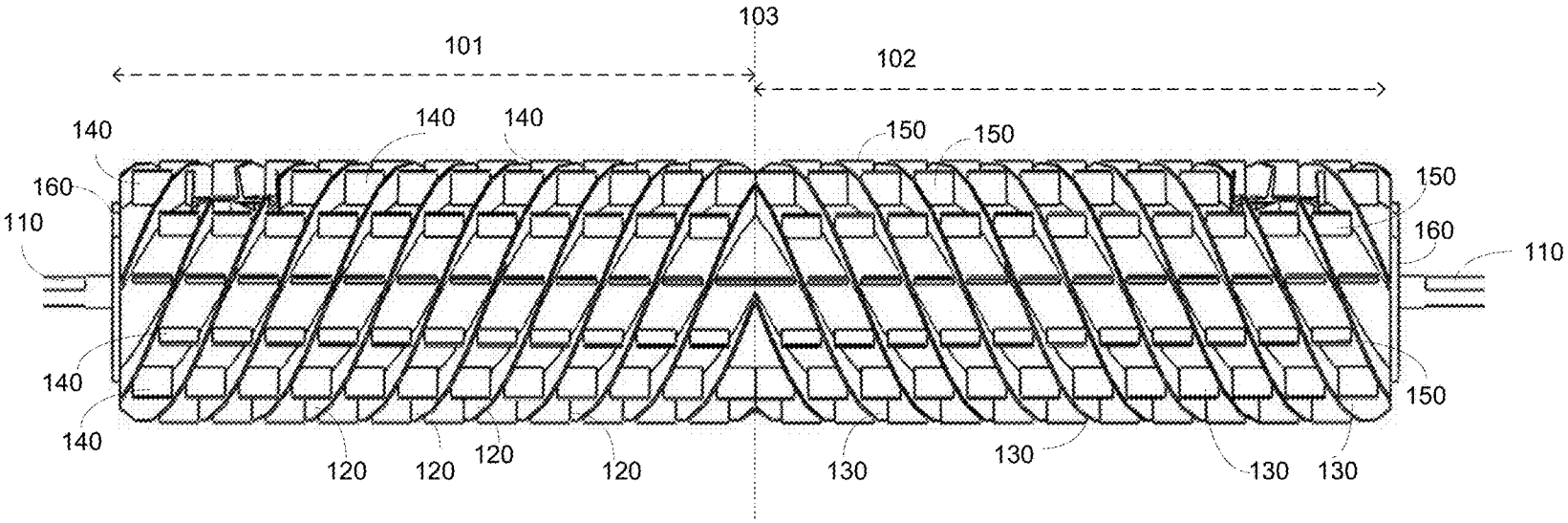
FIG. 1 illustrates a cleaning brush according to an embodiment of the invention.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF THE DRAWINGS

In the following detailed description, numerous specific details are set forth in order to provide a thorough understanding of the invention. However, it will be understood by those skilled in the art that the present invention may be practiced without these specific details. In other instances, well-known methods, procedures, and components have not been described in detail so as not to obscure the present invention.

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings.

Because the illustrated embodiments of the present invention may for the most part, be implemented using electronic and mechanical components known to those skilled in the art, details will not be explained in any greater extent than that considered necessary as illustrated above, for the understanding and appreciation of the underlying concepts of the present invention and in order not to obfuscate or distract from the teachings of the present invention.

The terms "mud", "dirt", "particles" and "debris" are being used in an interchangeable manner.

The term "pool" means any element that is capable of containing fluid.

The term "oriented" means an angular difference of at least one degrees and may include an orientation that has an absolute value of at least 5, 10, 15, 20, 25, 30, 35, 40, 45, 50, 55, 60, 65, 70, 75, 80, 85 and 90 degrees or angle of between 5 to 90 degrees.

There are provided cleaning brushes and pool cleaning apparatus. The pool cleaning apparatus may include one or more cleaning brushes and is capable of brushing, scrubbing and sweeping dirt while effectively capturing and diverting into an inlet of the pool cleaning apparatus a substantial amount of the dirt which it encounters. This release of dirt and its collection may be done in a single sweep with the reduced necessity to wait to perform another sweep in the same cleaning area of the pool.

The various figures show cleaning brushes that have (a) protuberances such as segmented fins and (b) fins that are arranged to direct debris to desired locations and may also cut the debris.

The pool cleaning apparatus may include two substantially parallel (substantially may mean deviation of up to few degrees, 10 degrees, 20 degrees and the like) cleaning brushes that are rotated about their longitudinal axis for propelling the pool cleaning apparatus while cleaning a surface of the pool.

The pool cleaning apparatus has a housing and each cleaning brush may be rotatably mounted on the front and rear ends of the housing respectively for propelling the pool cleaning apparatus along the surface of the cleaning area.

Each cleaning brush may be made (or at least may include a component that is made of) a somewhat soft polymeric material that is fitted in a way in which said material wraps/engulfs and is attached or over molded onto a central portion such as a central portion that has a longitudinal axis. The longitudinal axis of the cleaning brush may be oriented (for example perpendicular) to a longitudinal axis of the pool cleaning robot.

According to an embodiment of the invention the brushing, scrubbing wheel (or at least its exterior) may be made of a unitary vulcanized or injection molded polymer.

Figure 2:
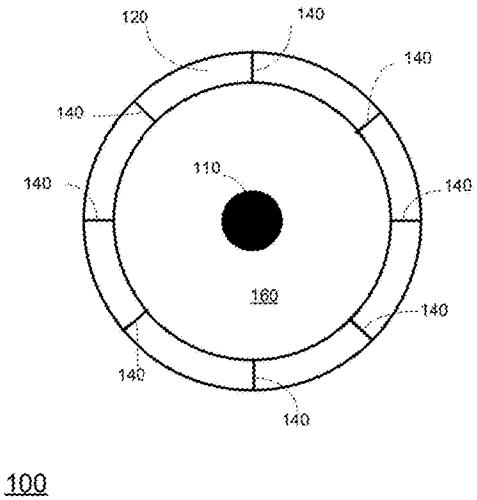
FIG. 2 is a cross sectional view of a cleaning brush according to an embodiment of the invention.

FIG. 1 illustrates a cleaning brush 100 according to an embodiment of the invention. FIG. 2 is a cross sectional view of a cleaning brush 100 according to an embodiment of the invention.

Figure 6A:
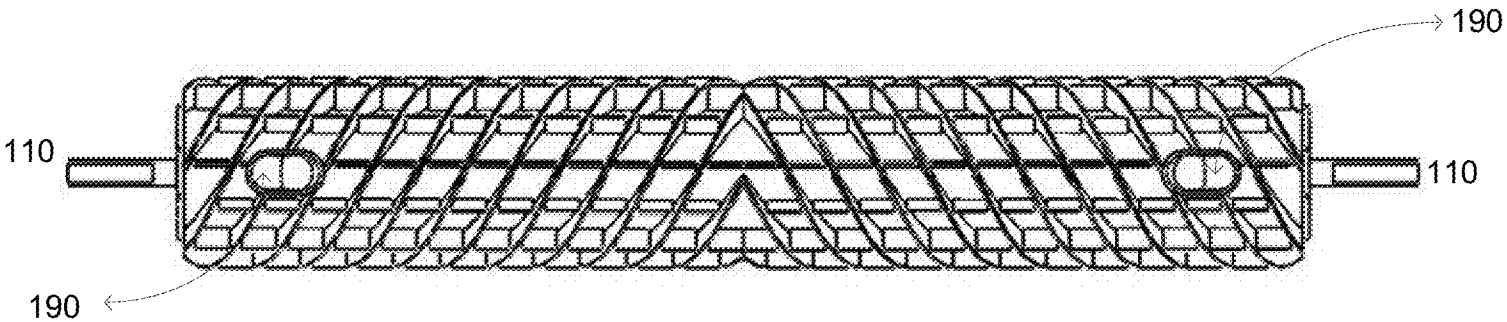
FIG. 6A illustrates a cleaning brush according to an embodiment of the invention.

FIGS. 3A-3D, 4A-4C and 5A are front views of cleaning brush 100 according to various embodiments of the invention. FIG. 6A illustrates a cleaning brush 100 according to an embodiment of the invention.

According to an embodiment of the invention the cleaning brush 100 includes:

a. A central portion 160 (such as a central tube) that has a longitudinal axis (denoted 111 in FIG. 3). It is noted that although the figures illustrate a central portion that is a central tube other shaped central portions can be provided.

b. Right handed helical fin 120 that surrounds a first section 101 of the central portion 160.

c. Left handed helical fin 130 that surrounds a second section 102 of the central portion 160.

While FIG. 1 illustrates fins that form right handed and left handed fins 120 and 130—these fins can be replaced by spaced apart ring shaped fins that surround the central portion 160.

According to various embodiments of the invention the cleaning brush 100 also includes (a) first protuberances 140 that are oriented in relation to the right handed fin 120 and (b) second protuberances 150 that are oriented in relation to the left handed fin 130.

FIGS. 3A-3D illustrate a cleaning brush 100 that includes (a) first fins 121 that have a positive slope in relation to the longitudinal axis 111 and surround a first section 102 of central portion 160 and (b) second fins 122 that have a negative slope in relation to the longitudinal axis 111 and surround a second section of the central portion 160.

FIG. 1 also illustrates (a) first protuberances 140 that are oriented in relation to the first fins and (b) second protuberances 150 that are oriented in relation to the second fins.

Figure 3A:
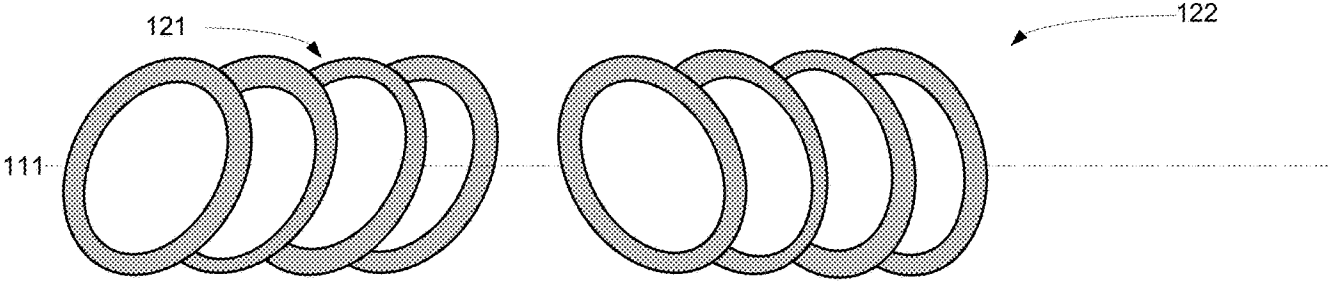
FIG. 3A illustrates ring shaped fins of a cleaning brush according to an embodiment of the invention.
Figure 3B:
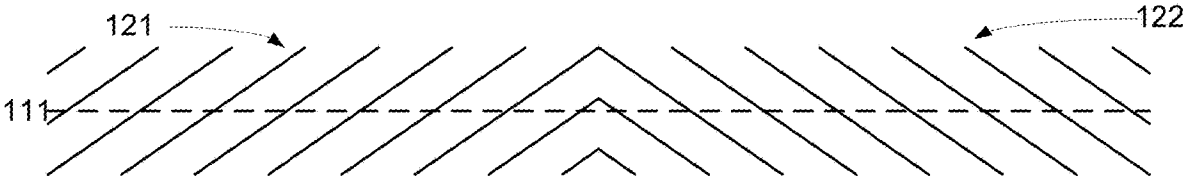
FIG. 3B is a front view of a cleaning brush according to an embodiment of the invention.
Figure 3C:
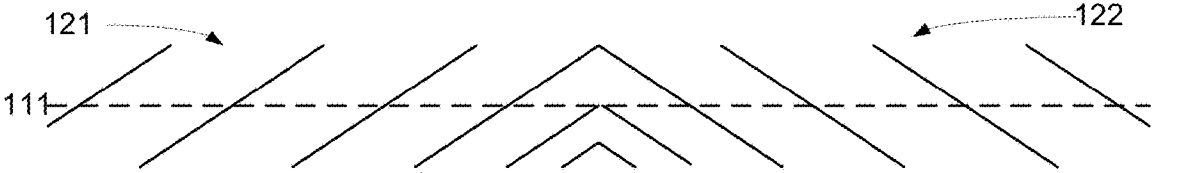
FIG. 3C is a front view of a cleaning brush according to an embodiment of the invention.
Figure 3D:
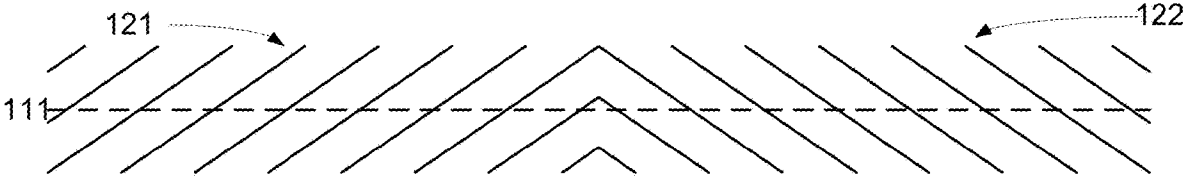
FIG. 3D is a front view of a cleaning brush according to an embodiment of the invention.

It is noted that any reference to the right handed and left fins 120 and 130 is applicable mutatis mutandis to the first and second ring shaped fins 121 and 122 of FIGS. 3B-3D.

The central portion 160 can have a cylindrical shape and can be separate from or integrated with at least one component out of the right handed fin 120, the left handed fin 130, the first protuberances 140 and the second protuberances 150.

FIGS. 1, 3B, 3C, 3D 4A, 4B, 4C, 6A, 8, 9 and 10 illustrate first and second sections that are of equal length—each equals one half of the length of the cleaning brush. It is noted that the first and second portions may differ from each other by length (see, FIG. 5A). It is also noted that other embodiments may exist where the length of each one of the first and second sections may be shorter than one half of the length of the cleaning brush 100 (see, FIG. 5B).

FIGS. 1, 4A and 7-10 illustrate the first protuberances 140 and the second protuberances 150 as being identical to each other, being arranges in rows that are parallel to the longitudinal axis 111 and as extending radially from the central portion 160. It is noted that the shape, size, orientation and arrangement of these first and second protuberances 140 and 150 may differ from those illustrated in FIGS. 1, 4A and 7-10.

Figure 4A:
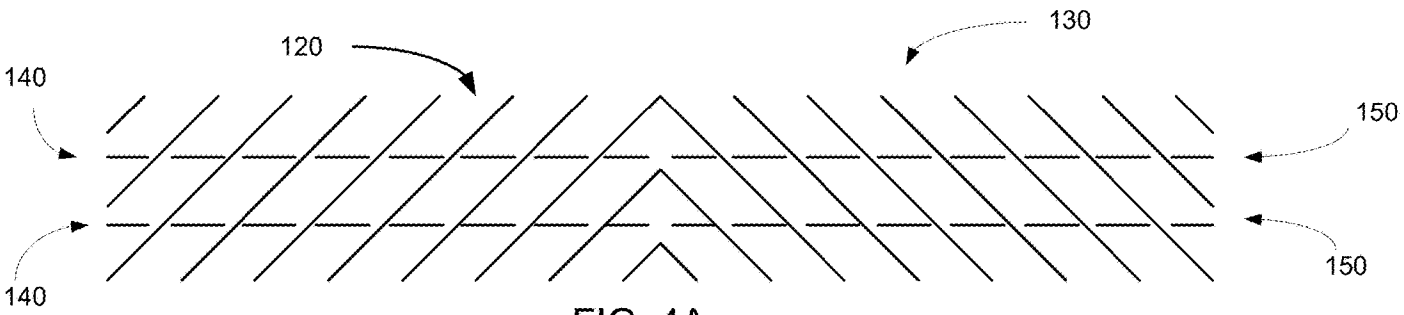
FIG. 4A is a front view of a cleaning brush according to an embodiment of the invention.
Figure 4B:
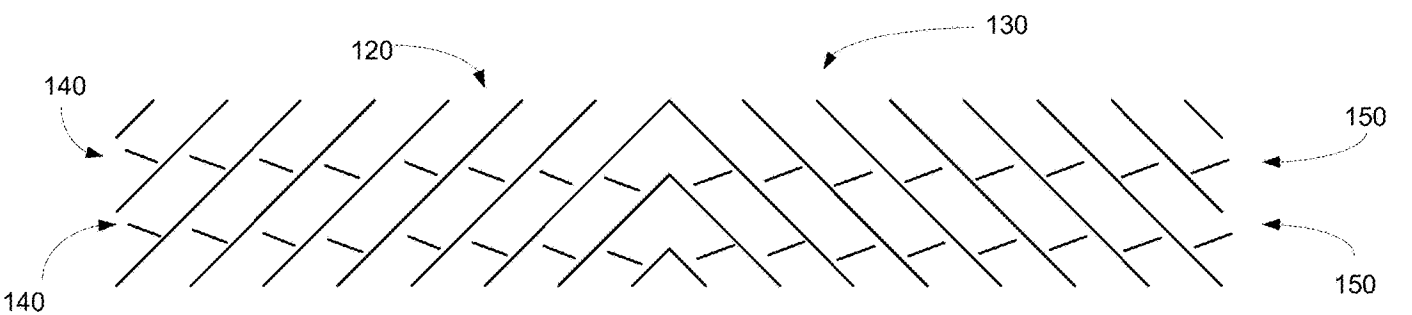
FIG. 4B is a front view of a cleaning brush according to an embodiment of the invention.

For example, the first and second protuberances 140 and 150 may be arranged in a manner that is not parallel (is oriented) to the longitudinal axis 111—as illustrated in FIG. 4B.

Figure 4C:
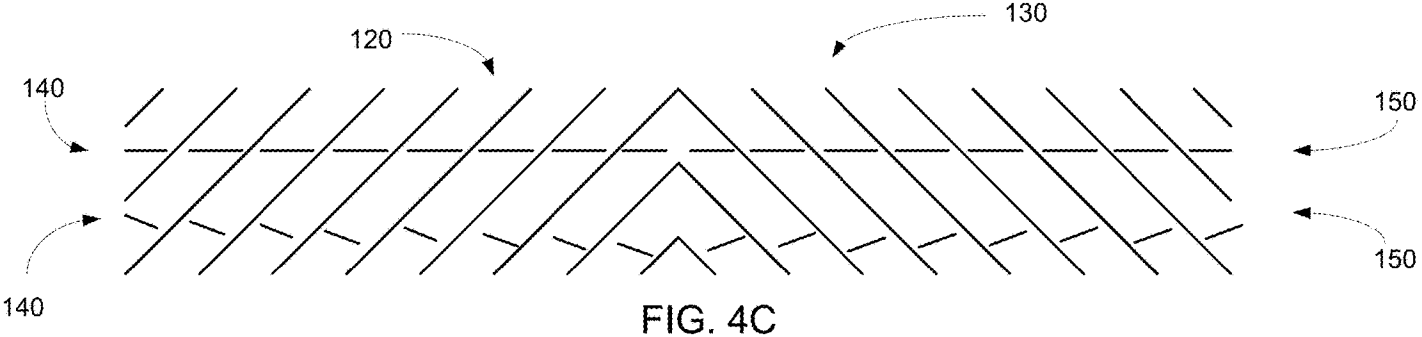
FIG. 4C is a front view of a cleaning brush according to an embodiment of the invention.

Alternatively—some of the first and second protuberances 140 and 150 may be arranged in a manner that is parallel to the longitudinal axis 111 and some of the first and second protuberances 140 and 150 may be arranged in a manner that is not parallel (is oriented) to the longitudinal axis 111—as illustrated in FIG. 4C.

Yet for another example—two or more protuberances out of the first and second protuberances 140 and 150 may differ from each other by shape, size and/or orientation.

The cleaning brush 100 is illustrated in FIGS. 1, 3A, 3B, 3C, 3D, 4A, 4B, 4C and 7-10 as including an axis of symmetry (denoted 103 in FIG. 1) wherein the first and second sections 101 and 102 are mutually symmetrical about this axis, the first protuberances 140 and the second protuberances 150 are symmetrical about this axis and the right handed fin 120 and the left handed fin 130 are symmetrical about this axis.

Alternatively—axis 103 is not a symmetry axis and at least one component (first section 101, right handed fin 120 and first protuberances 140) on side of the axis differs from another component (second section 102, left handed fin 130, and the second protuberances 150) located at another side of the axis.

Figure 6B:
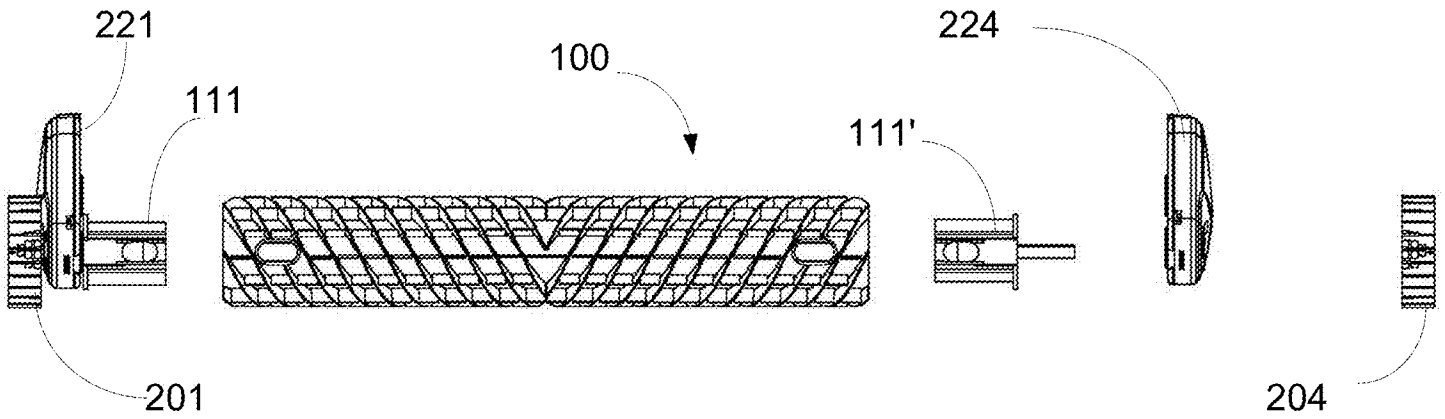
FIG. 6B illustrates an interface of a cleaning brush, a cleaning brush and additional components according to an embodiment of the invention.
Figure 6C:
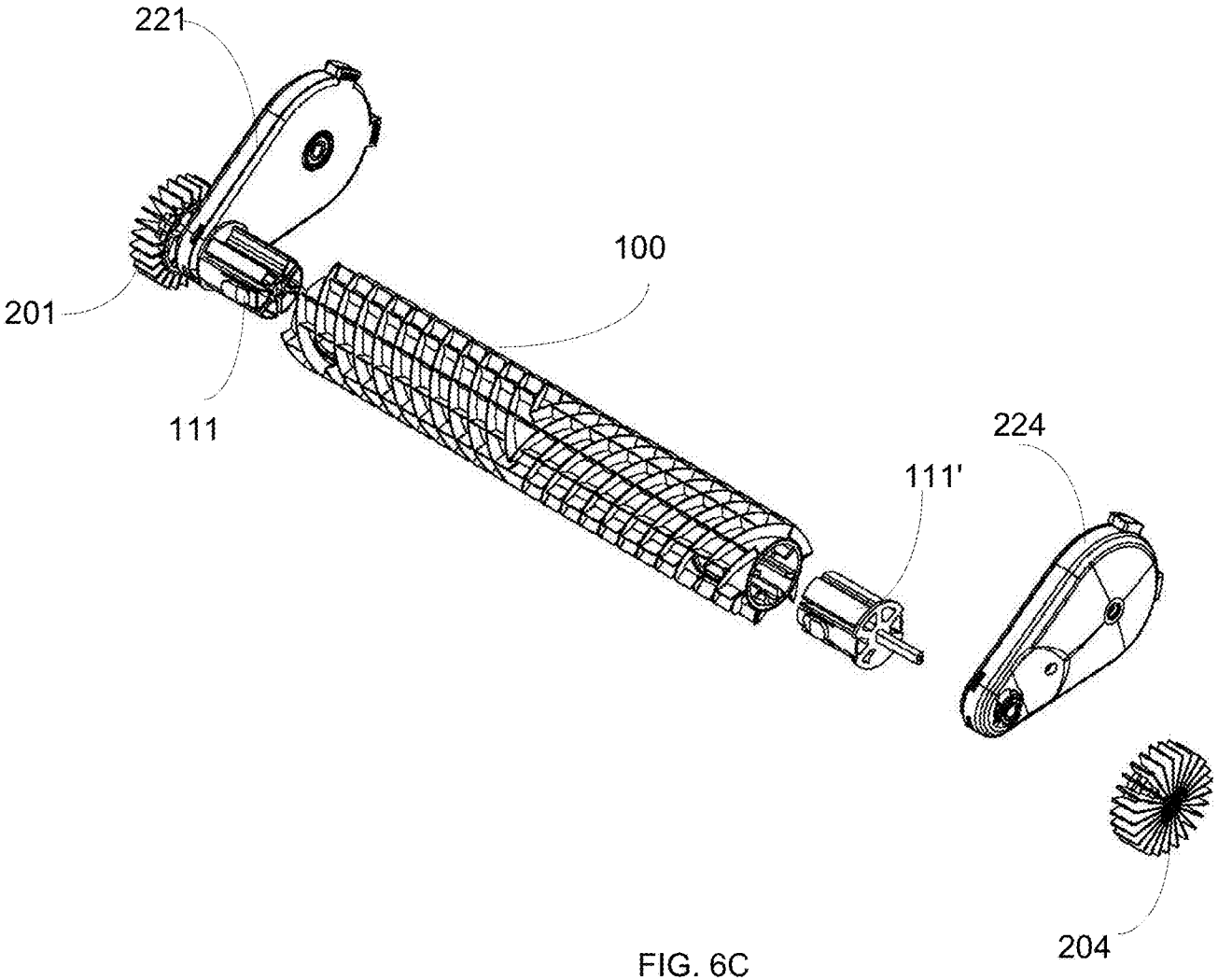
FIG. 6C illustrates an interface of a cleaning brush, a cleaning brush and additional components according to an embodiment of the invention.
Figure 6D:
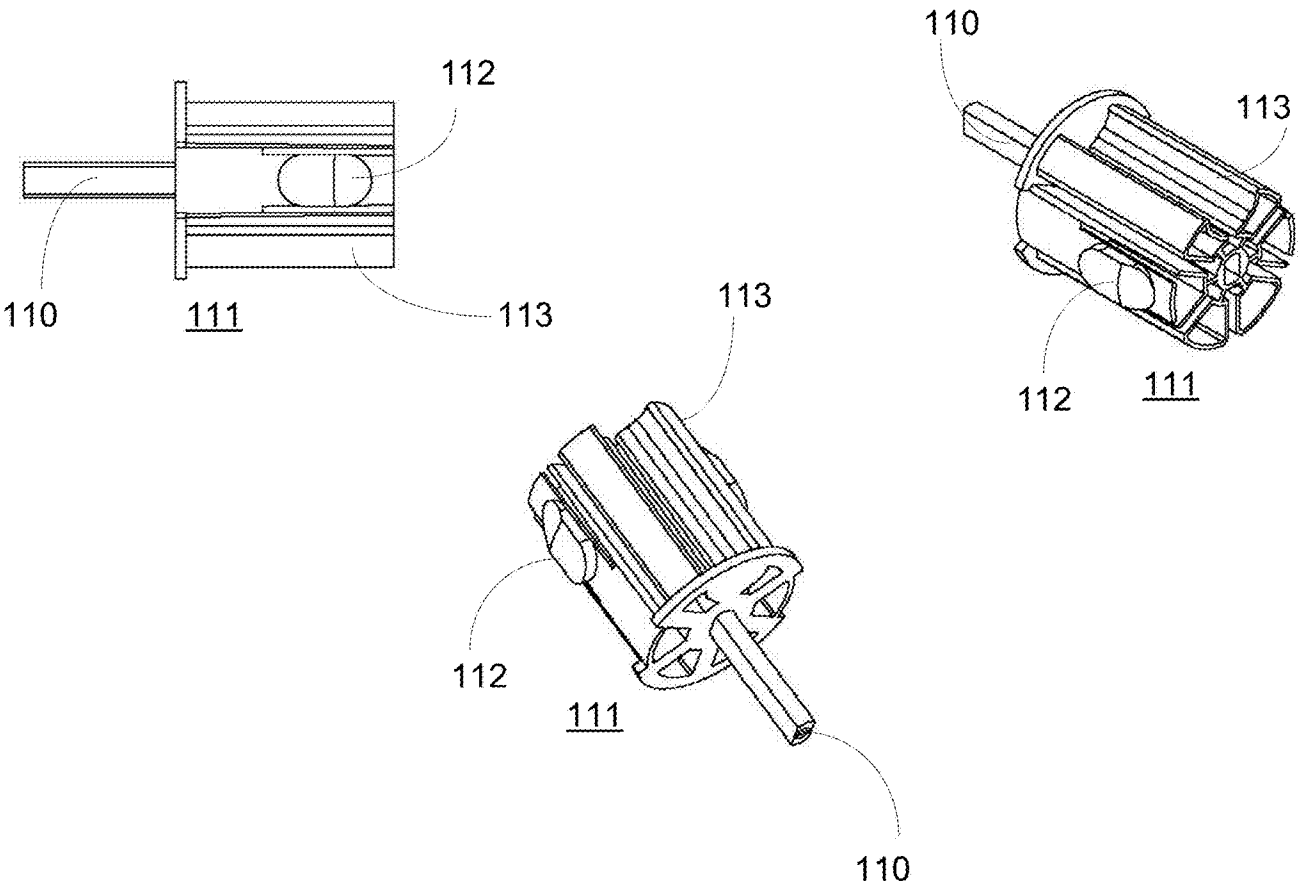
FIG. 6D illustrates an interface of a cleaning brush according to an embodiment of the invention.

FIG. 6D illustrates an interface 111 of a cleaning brush 100 according to an embodiment of the invention. FIGS. 6C and 6D illustrate interfaces 111 and 111' of a cleaning brush 100, a cleaning brush 100 and additional components 201, 204, 221 and 224 according to an embodiment of the invention.

According to an embodiment of the invention the cleaning brush 100 has an interface (such as interfaces 111 of FIGS. 6B-6D)—one interface at each side of the cleaning brush for detachably connecting the cleaning brush 100 to the pool cleaning apparatus. The cleaning brush may have at least one opening (openings 190 of FIG. 6A) that allows access to interface 111 and especially to a snap action lock 112 of interface 111 that facilitate a detachment of the cleaning brush 100 from the pool cleaning apparatus by pressing the snap action lock 112.

The snap action lock 102 can include a movable element that can be moved from being at a first position in which it prevents the cleaning brush 100 from being removed from the pool cleaning apparatus and a second position in which is allows the detachment of the cleaning brush from the pool cleaning apparatus. The snap action lock 112 can be moved vertically or radially (or in any other manner) between these positions. For example—when in the first position the snap action lock 102 can extend through the opening 190 or another opening while when in the second position the snap action lock 102 can be pushed away from that opening. In FIG. 6D the interface 111 is shown as including an axis 110 that may be rotated by a movement module (such as movement modules 221, 222, 223 and 224), a main body 113 and the snap action lock 112.

After being pushed out of the openings of the snap action locks 112 can be snap pressed in and pulled out of the central portion.

Alternatively, the interface can be released from the cleaning brush by unscrewing screws that connect the interface 111 to the pool cleaning apparatus—the openings are wide enough to allow inserting a screwdriver there-through.

Figure 5A:
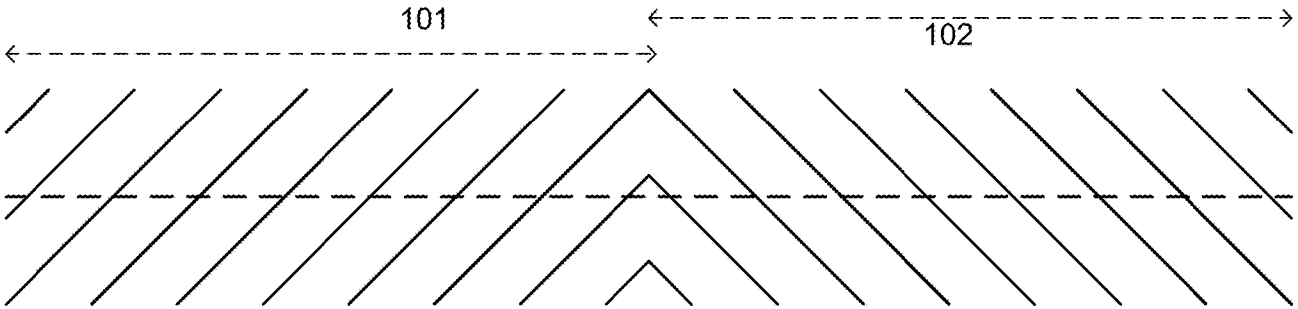
FIG. 5A is a front view of a cleaning brush according to an embodiment of the invention.
Figure 5B:
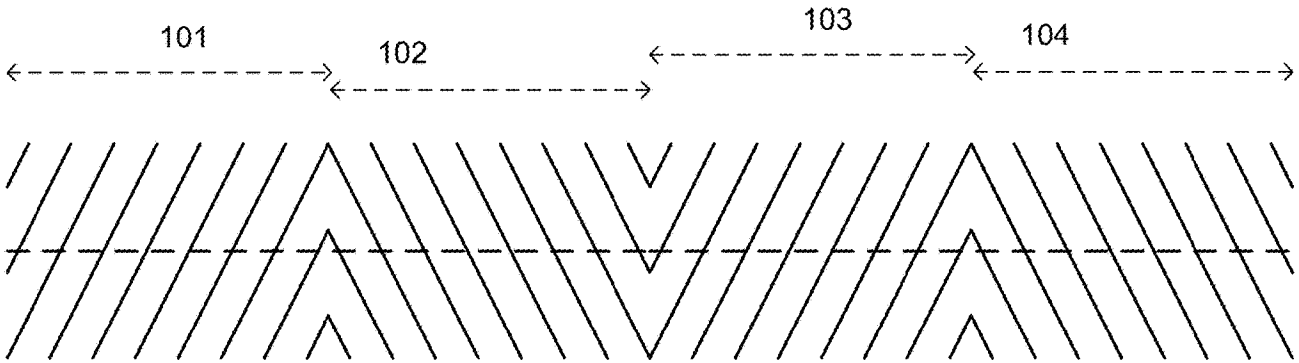
FIG. 5B is a front view of a cleaning brush according to an embodiment of the invention.

FIG. 5B illustrates a cleaning brush 100 that includes four sections 101 (not shown), 102, 103 (symmetry line is not shown), and 104—two right handed fins 101 and 103 as well as two left handed fins 102 and 104. This cleaning brush 100 may also have first and second protuberances such as those illustrated in any of the previous figures. That cleaning brush can have ring shaped fins instead of such right and left handed fins.

It is noted that the cleaning brush can have multiple right handed fins and multiple left handed fins.

It is noted that the cleaning brush can have a combination of one or more right handed fins and ring shaped fins. Additionally or alternatively, the cleaning brush can include a combination of one or more left handed fins and ring shaped fins.

The distance between different windings of a right handed fin may be the same. Alternatively, a first pair of windings of the right handed fin may be distant from each other by a distance between a second pair of windings of the right handed fin or a distance between a third pair of windings of a left handed fin of the same cleaning brush.

The distance between different windings of a left handed fin may be the same. Alternatively, a first pair of windings of the left handed fin may be distant from each other by a distance between a second pair of windings of the left handed fin or a distance between a third pair of windings of a right handed fin of the same cleaning brush.

The distance between different first ring shaped fins may be the same. The distance between different second ring shaped fins may be the same. Alternatively, a first pair of first ring shaped fins may be distant from each other by a distance that differs from the distance between a second pair of first ring shaped fins or a distance between a third pair of second ring shaped fins. An example of differences between inter-ring shaped fins is shown in FIG. 3C—see, for example, distance 171 is bigger than distance 172. While in FIG. 3C the distances between ring shaped fins increases towards the edges of the cleaning brush—these distances can decrease towards the edges of the cleaning brush, or change in a non-monotonic manner.

Various figures such as FIGS. 1 and 7-10 illustrate the right handed fin 120 as having windings that are parallel to each other and the left handed fin 130 as having windings that are parallel to each other. According to various embodiments of the invention at least one of the winding of a certain fin (first or second) can be non-parallel to another winding of that certain fin. The same applies to ring shaped fins.

Various figures such as FIG. 3B shows first rings 121 of positive slope and second rings 122 of negative slope wherein an absolute value of the positive slope substantially equals to an absolute value of the negative slope. It is noted that the absolute value of the positive slope may differ from the absolute value of the negative slope.

Figure 7:
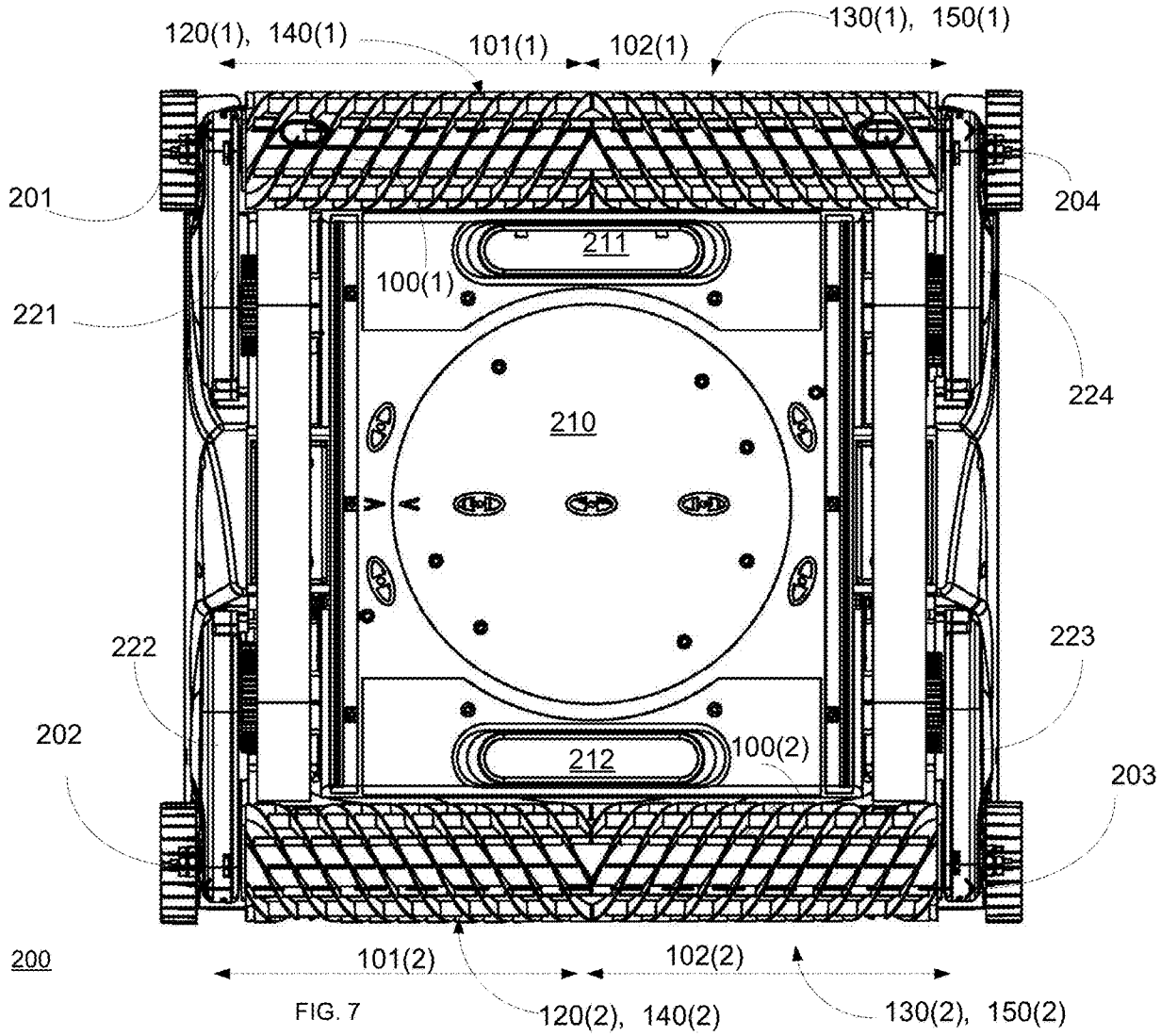
FIG. 7 illustrates a bottom view of a pool cleaning apparatus according to an embodiment of the invention.

FIG. 7 illustrates a bottom view of a pool cleaning apparatus 200 according to an embodiment of the invention.

The bottom panel 210 of the pool cleaning apparatus 200 has two inlets 211 and 212—located at the center of the pool cleaning apparatus 200. FIG. 7 also shows four side brushes 201-204.

A combination of any of the cleaning brushes illustrated in any previous figures can be detachably connected to other elements of a pool cleaning apparatus. Alternatively, the pool cleaning apparatus can include one or more cleaning brushes as illustrated in any of the previous figures and any other shaped and sized cleaning brush known in the art.

Referring to FIG. 7—pool cleaning apparatus 200 includes first and second cleaning brushes 100(1) and 100 (2)—each is identical to the cleaning brush 100 of FIG. 1.

The first cleaning brush 100(1) includes a first central portion (such as central portion 160 of FIG. 6*b*) that has a first longitudinal axis (such as longitudinal axis 111 of FIG. 2); a first right handed fin 120(1) that surrounds a first section 101(1) of the first central portion; and a first left handed fin 130(1) that surrounds a second section 102(1) of the first central portion 160.

FIG. 7 also shows the first cleaning brush 101(1) as including first protuberances 140(1) that are oriented in relation to the first right handed fin 120(1) and second protuberances 150(1) that are oriented in relation to the first left handed fin 130(1).

The second cleaning brush 101(2) includes a second central portion 160 (such as central portion 160 of FIG. 1) that has a second longitudinal axis (such as longitudinal axis 111 of FIG. 2); a second right handed fin 120(2) that surrounds a first section 101(2) of the second central portion; and a second left handed fin 130(2) that surrounds a second section 102(2) of the second central portion 160.

FIG. 7 also shows the second cleaning brush 100(2) as including third protuberances 140(2) that are oriented in relation to the second right handed fin 120(2) and forth protuberances 150(2) that are oriented in relation to the second left handed fin 130(2).

The pool cleaning apparatus has a movement module (illustrated by transmission mechanism 221, 222, 223 and 224) that is arranged to rotate the first and second cleaning brushes 100(1) and 100(2) in synchronicity to each other or independently from each other.

Figure 8:
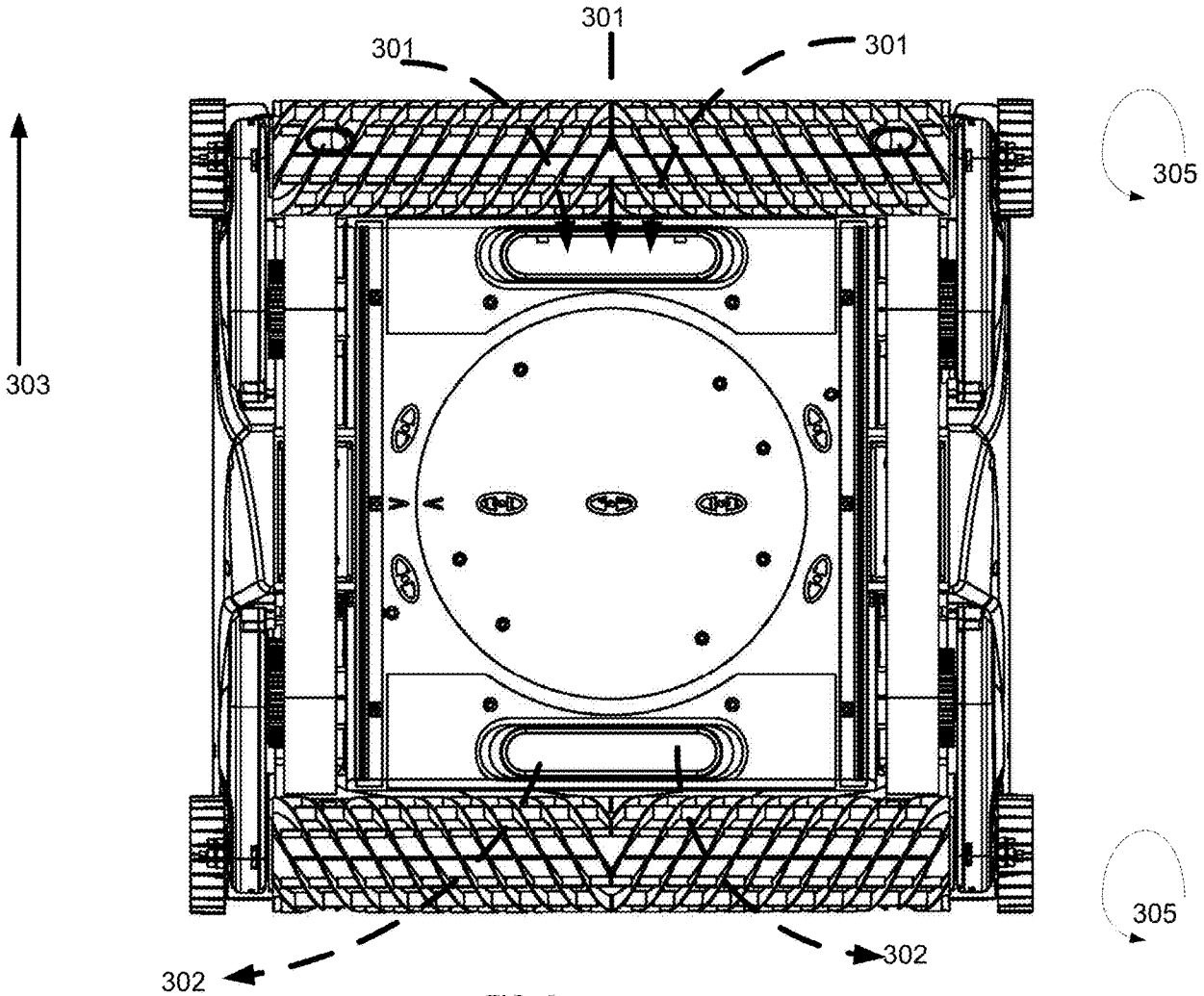
FIG. 8 illustrates a bottom view of a pool cleaning apparatus according to an embodiment of the invention.
Figure 9:
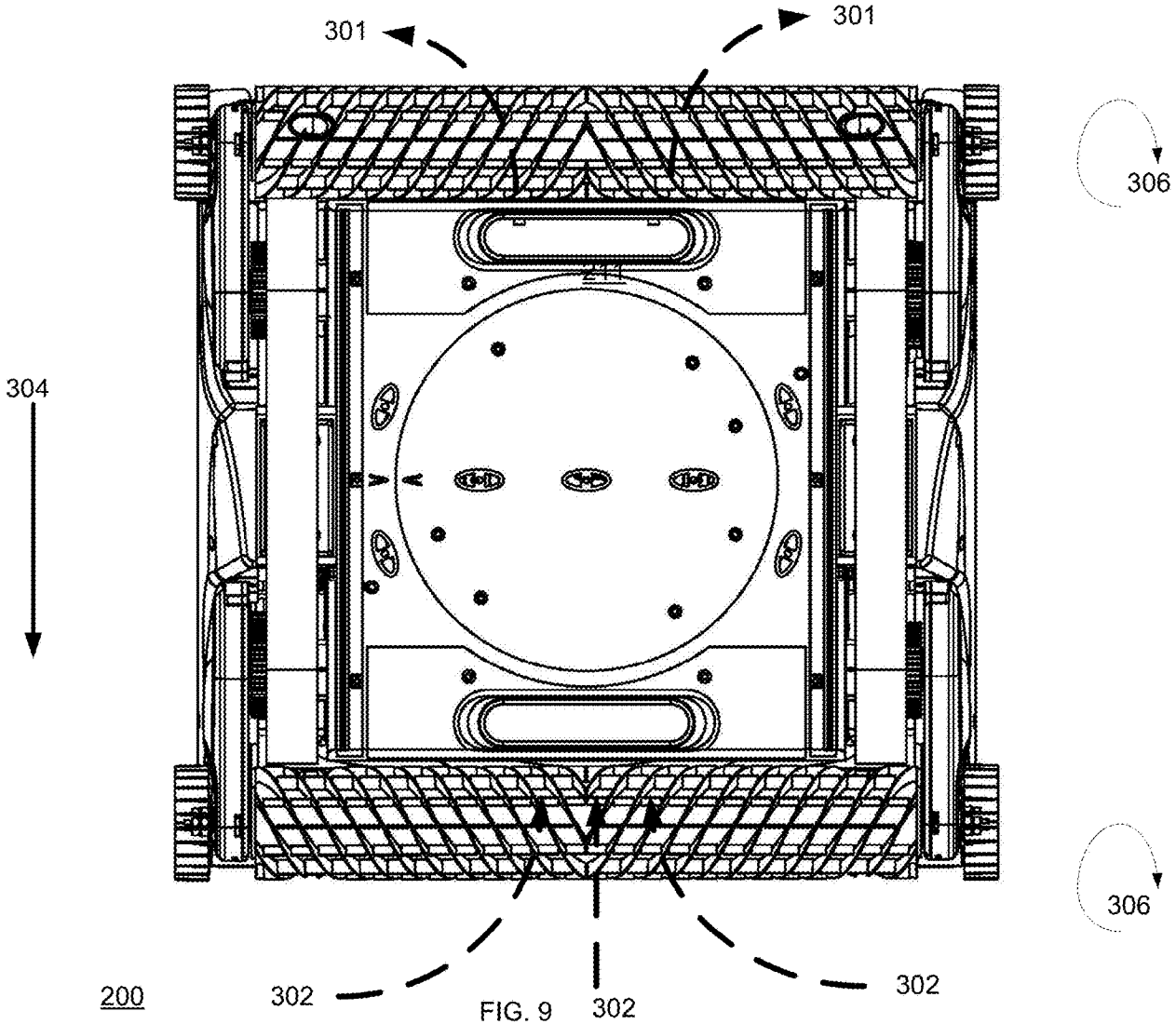
FIG. 9 illustrates a bottom view of a pool cleaning apparatus according to an embodiment of the invention.

FIG. 8 illustrates a bottom view of a pool cleaning apparatus 200 when propagating along a first direction 303 in which a first cleaning brush 100(1) is a front cleaning brush according to an embodiment of the invention. FIG. 9 illustrates a bottom view of a pool cleaning apparatus 200 when propagating along a second direction 304 that is opposite to the first direction 303 in which a first cleaning brush 100(1) is a rear cleaning brush, according to an embodiment of the invention.

FIGS. 8 and 9 illustrates the first and second cleaning brushes 100(1) and 100(2) as being rotated at a same rotational direction (counterclockwise 305 in FIG. 8 and clockwise 306 in FIG. 9) about their longitudinal axes.

In FIG. 8 the movement module shown as being arranged to rotate the first and second cleaning brushes 100(1) and 100(2) at the same rotational direction about their longitudinal axes thereby causing a front cleaning brush (first cleaning brush 100(1)) to direct debris (dashed arrows 301) towards a fluid inlet 211 of the pool cleaning apparatus 200 and causing a rear cleaning brush (second cleaning brush 100(2)) to direct debris (dashed arrows 302) away from a center of the pool cleaning apparatus 212.

In FIG. 9 the movement module shown as being arranged to rotate the first and second cleaning brushes 100(1) and 100(2) at the same rotational direction about their longitudinal axes thereby causing the front cleaning brush (second cleaning brush 100(2)) to direct debris (dashed arrows 302) towards a fluid inlet 212 of the pool cleaning apparatus 200 and causing a rear cleaning brush (first cleaning brush 100(1)) to direct debris (dashed arrows 301) away from a center of the pool cleaning apparatus 211.

Figure 10:
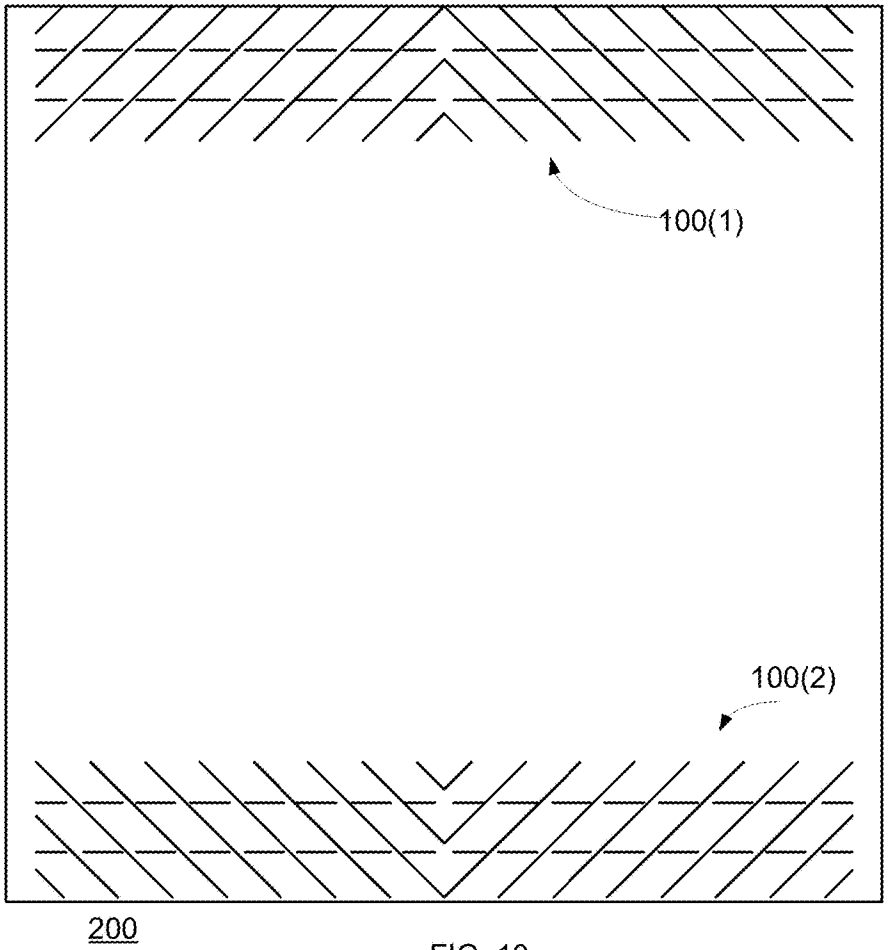
FIG. 10 illustrates a bottom view of a pool cleaning apparatus according to an embodiment of the invention.

FIG. 10 illustrates a pool cleaning apparatus 200 that includes two cleaning brushes 100(1) and 100(2) that are identical to the cleaning brushes of FIG. 3B.

Figure 11:
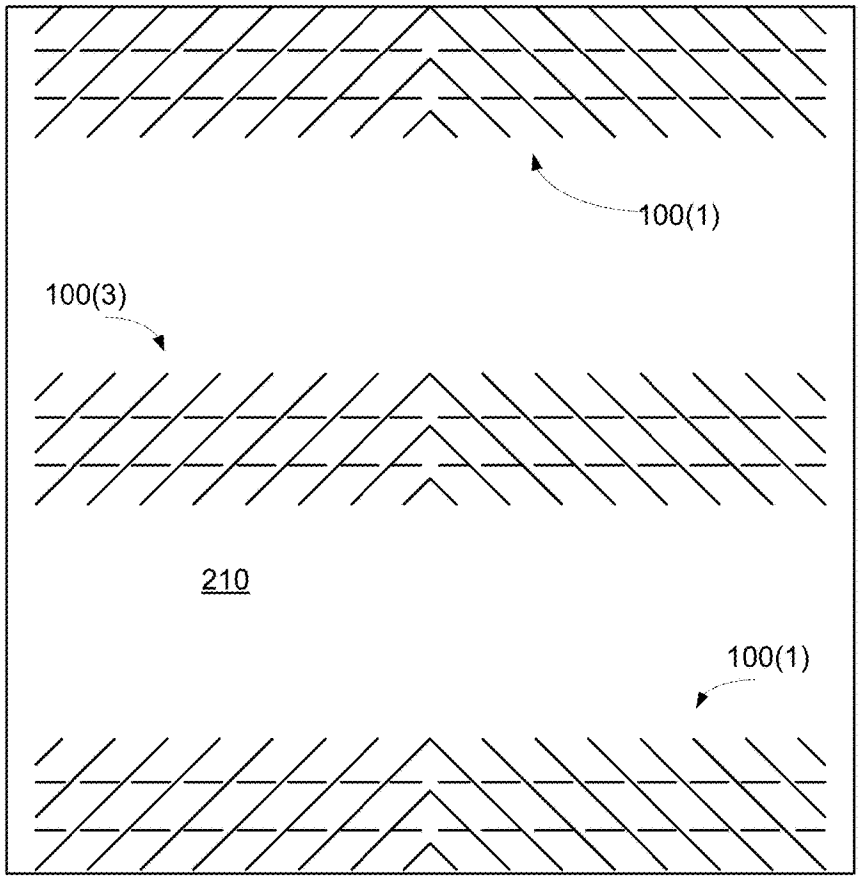
FIG. 11 illustrates a bottom view of a pool cleaning apparatus according to an embodiment of the invention.

The pool cleaning apparatus may include at least one intermediate brush positioned between the first and second cleaning brushed 100(1) and 100(2)—such as intermediate brush 100(3) of FIG. 11.

In the foregoing specification, the invention has been described with reference to specific examples of embodiments of the invention. It will, however, be evident that various modifications and changes may be made therein without departing from the broader spirit and scope of the invention as set forth in the appended claims.

Moreover, the terms "rear," "front", "right", "left" and the like in the description and in the claims, if any, are used for descriptive purposes and not necessarily for describing permanent relative positions. It is understood that the terms so used are interchangeable under appropriate circumstances such that the embodiments of the invention described herein are, for example, capable of operation in other orientations than those illustrated or otherwise described herein.

Those skilled in the art will recognize that the boundaries between components are merely illustrative and that alternative embodiments may merge components or impose an alternate decomposition of functionality upon various components. Thus, it is to be understood that the arrangements of components depicted herein are merely exemplary, and that in fact many other architectures may be implemented which achieve the same functionality.

Any arrangement of components to achieve the same functionality is effectively "associated" such that the desired functionality is achieved. Hence, any two components herein combined to achieve a particular functionality may be seen as "associated with" each other such that the desired functionality is achieved, irrespective of architectures or intermedial components. Likewise, any two components so associated can also be viewed as being "operably connected," or "operably coupled," to each other to achieve the desired functionality.

Furthermore, those skilled in the art will recognize that boundaries between the above described operations merely illustrative. The multiple operations may be combined into a single operation, a single operation may be distributed in additional operations and operations may be executed at least partially overlapping in time. Moreover, alternative embodiments may include multiple instances of a particular operation, and the order of operations may be altered in various other embodiments.

However, other modifications, variations and alternatives are also possible. The specifications and drawings are, accordingly, to be regarded in an illustrative rather than in a restrictive sense.

In the claims, any reference signs placed between parentheses shall not be construed as limiting the claim. The word 'comprising' does not exclude the presence of other elements or steps then those listed in a claim. Furthermore, the terms "a" or "an," as used herein, are defined as one or more than one. Also, the use of introductory phrases such as "at least one" and "one or more" in the claims should not be construed to imply that the introduction of another claim element by the indefinite articles "a" or "an" limits any particular claim containing such introduced claim element to inventions containing only one such element, even when the same claim includes the introductory phrases "one or more" or "at least one" and indefinite articles such as "a" or "an." The same holds true for the use of definite articles. Unless stated otherwise, terms such as "first" and "second" are used to arbitrarily distinguish between the elements such terms describe. Thus, these terms are not necessarily intended to indicate temporal or other prioritization of such elements. The mere fact that certain measures are recited in mutually different claims does not indicate that a combination of these measures cannot be used to advantage.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

We claim:

1. A cleaning brush for a pool cleaning apparatus, the cleaning brush comprises:

a central portion that has a longitudinal axis;

a right handed fin that surrounds multiple times a first section of the central portion;

a left handed fin that surrounds multiple times a second section of the central portion;

wherein each one of the central portion, the first section of the central portion and the second section of the central portion has a cylindrical shape;

first protuberances that are oriented in relation to the right handed fin; and second protuberances that are oriented in relation to the left handed fin.

2. The cleaning brush according to claim 1, wherein the first and second sections are of equal length.

3. The cleaning brush according to claim 1, wherein the first and second protuberances are substantially parallel to the longitudinal axis.

4. The cleaning brush according to claim 1, wherein the right handed fin and the left handed fin are mutually symmetrical about a symmetry axis that virtually separates the central portion to the first and second sections of the central portion.

5. The cleaning brush according to claim 4 wherein the symmetry axis is normal to the longitudinal axis.

6. The cleaning brush according to claim 1 wherein each one of the right handed fin and the left handed fin defines a helical path.

7. The cleaning brush according to claim 1 wherein the right handed fin surrounds the first section of the central portion eleven times.

8. The cleaning brush according to claim 1 wherein the first protuberances and the second protuberances are mutually symmetrical about a symmetry axis that virtually separates the central portion to the first and second sections of the central portion.

9. The cleaning brush according to claim 1 wherein the first protuberances and the second protuberances are identical to each other.

10. The cleaning brush according to claim 1 wherein the first protuberances and the second protuberances are arranged in rows that are parallel to the longitudinal axis and are extending radially from the central portion.

11. The cleaning brush according to claim 1 wherein the first protuberances are oriented in relation to the right handed fin by an orientation that has an absolute value of at least 25 degrees.

12. The cleaning brush according to claim 1 wherein the first protuberances are oriented in relation to the right handed fin by an orientation that has an absolute value of at least 55 degrees.

13. The cleaning brush according to claim 1 wherein the first protuberances are oriented in relation to the right handed fin by an orientation that ranges between 5 to 90 degrees.

* * * * *